United States Patent [19]

Ellis

[11] 4,360,430

[45] Nov. 23, 1982

[54] SPILL RETRIEVAL MECHANISM FOR REMOVING A SPILLED SUBSTANCE FROM A LIQUID SURFACE

[76] Inventor: Royd H. Ellis, 1200 N. Capital St., Washington, D.C. 20001

[21] Appl. No.: 260,707

[22] Filed: May 5, 1981

[51] Int. Cl.[3] ..... B01D 17/02; F02B 15/04

[52] U.S. Cl. ..... 210/242.3; 210/923

[58] Field of Search ..... 210/242.3, 923, 526

[56] References Cited

U.S. PATENT DOCUMENTS

| | | | |
|---|---|---|---|
| Re. 30,729 | 9/1981 | Farrell et al. | 210/923 |
| 3,314,540 | 4/1967 | Lane | 210/923 |
| 3,403,098 | 9/1968 | Hirs | 210/923 |
| 3,581,899 | 6/1971 | Hunter | 210/242.1 |
| 3,613,891 | 10/1971 | Cloutier | 210/526 |
| 3,637,080 | 1/1972 | Markel | 210/242.3 |
| 3,643,804 | 2/1972 | Sharpton | 210/526 |
| 3,670,896 | 6/1972 | Hale, Jr. | 210/242.3 |
| 3,700,108 | 10/1972 | Richards | 210/923 |
| 3,762,558 | 10/1973 | Anderson | 210/242.3 |
| 3,817,385 | 6/1974 | Bergman | 210/242.3 |

*Primary Examiner*—Ernest G. Therkorn

*Attorney, Agent, or Firm*—Blair, Brown & Kreten

[57] ABSTRACT

Disclosed herein is a spill retrieval mechanism for removing a spilled substance from a liquid surface and placing the substance in a reservoir which includes a trough having a conveyor operatively disposed thereon, a motor system for driving the conveyor, a scoop associated with the trough for directing the liquid and substance to the conveyor, a surface on the conveyor for retaining the spilled substance thereon, and a removal device extending between the conveyor and an associated reservoir to remove the substance from the conveyor and place it into the reservoir. The device also includes structure to alter the angulation of the trough and conveyor to different angles of attack based on the requirements and particular job application.

9 Claims, 3 Drawing Figures

FIG 1
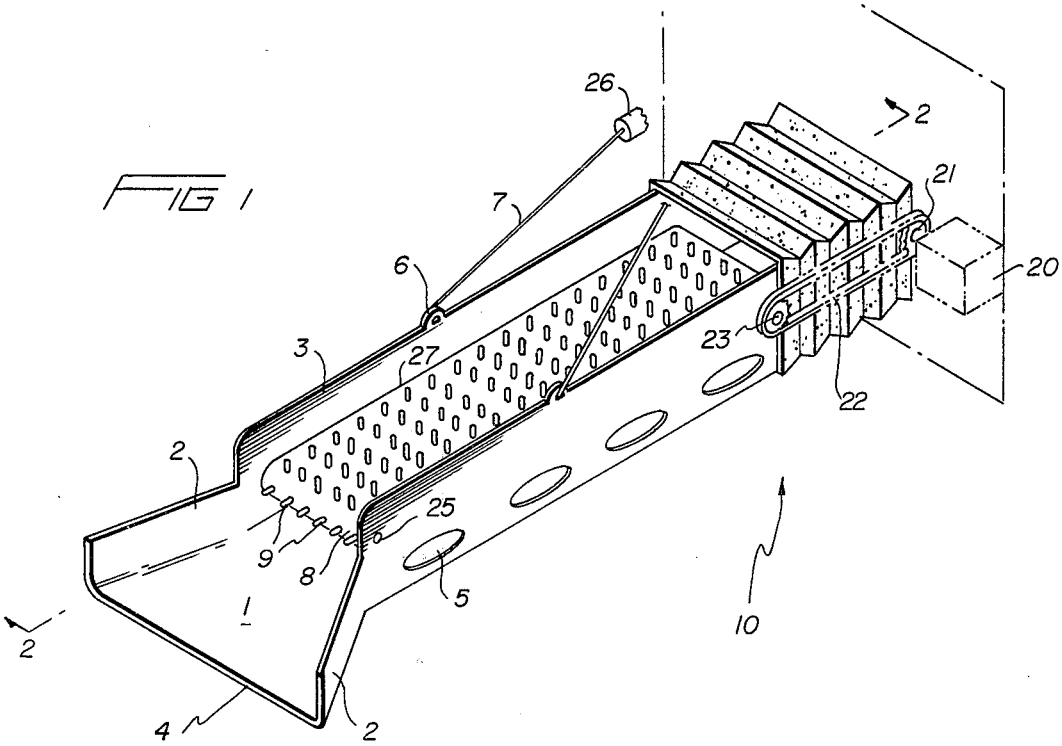
FIG 2
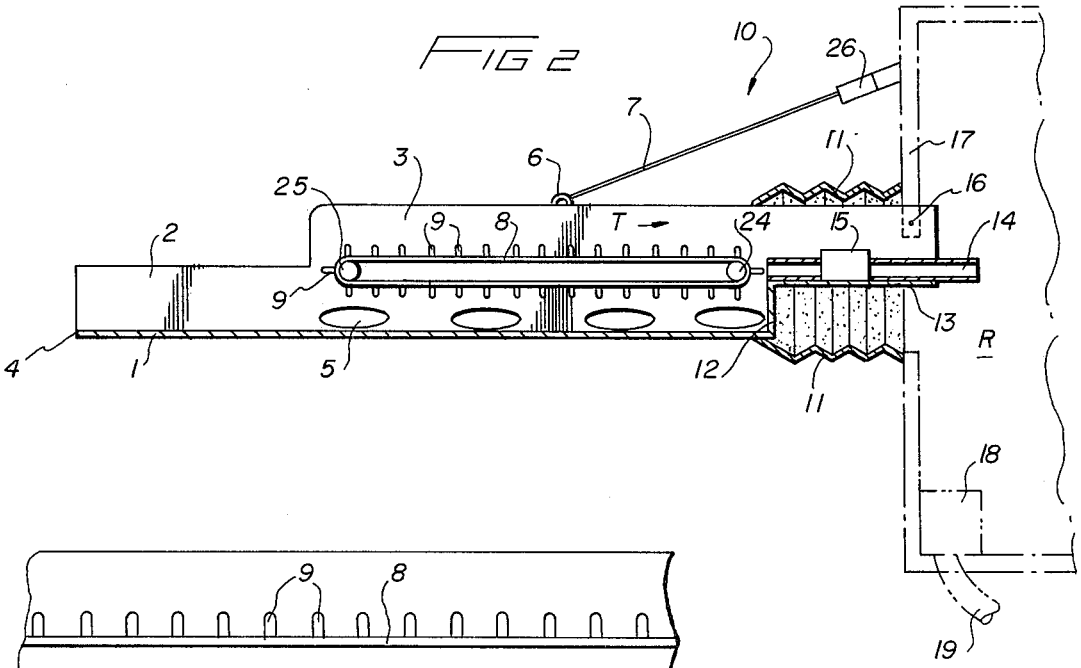
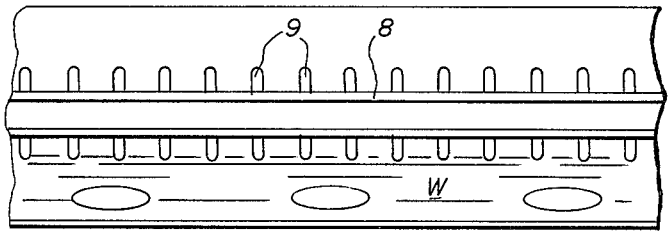
FIG 3

SPILL RETRIEVAL MECHANISM FOR REMOVING A SPILLED SUBSTANCE FROM A LIQUID SURFACE

BACKGROUND OF THE INVENTION

This invention relates generally to a mechanism for retrieving spilled substances from a liquid surface and placing the substance in a reservoir, and specifically is directed to an oil spill retrieval device.

It is well known that the contamination associated with an oil spill or a spill of any chemical on a body of water can have extremely dire consequences to the effected environment. Additionally however, the dispersion of the valuable oil or chemical is a luxury which can not be afforded in this day of conservation.

The following U.S. Pat. Nos. reflect the state of the art of which applicant is aware in so far as these patents appear to be germane to the instant application.

3,637,080 Markel
3,804,251 Farrell et al.
3,812,968 Aramaki et al.
4,105,554 Janson Of these references, the patent to Janson appears to be of great interest since he teaches the use of an oil spill retrieval system in which a conveyor 22 carries oil and water into plural reservoirs for subsequent separation so that the oil is stored and the cleaned water is eventually returned to the body of water. By way of contrast however, the instant application is directed to and claims a trough mechanism associated with a conveyor, the conveyor having a specific configuration to selectively move and separate the oil from the water in a single operation, and the trough being suitably configured to exclude debris and other contaminants that are not subject to processing. The screen 28 of the Janson device, while described as self cleaning includes a geometrical configuration in which the gates 27 and 29 tend to accumulate unwanted debris. Moreover, spilled oil of various viscosities may encounter difficulties in passing on to the conveyor itself.

The patent to Markel is of great interest since he teaches the use of a method and apparatus for skimming flotsam from the surface of a body of water. Floating material such as oil is directed towards and into pockets on a continuously driven conveyor belt which serves to submerge the floating material below the surface of the water. A transfer of the materials is made to a suitable conduit from which the floating material is pumped to a suitable reservoir or station where it is separated from the water. By way of contrast, the instant application is directed to and specifies using the natural buoyant tendency of the oil and it inherent immiscibility with the water to collect substantially all of the oil while allowing the water to return to the body of water without need for subsequent substantive separation, and to this end, does not attempt to force the oil below the surface of the liquid in direct contrast to this patent.

Farrell et al. teaches the use of a similar type of mechanism in which the oil is urged downwardly and rearwardly for subsequent separation.

The patent to Aramaki et al. teaches the use of a ship-like device for recovering pollutants from a water surface by forcing the pollutant carrying water into a downwardly directed bucket so that the pollutant floats on a calm water surface defined therein and a suction means collects the pollutant therefrom. A whirl-generator is contemplated as being disposed within the bucket.

Clearly, this device is more batch oriented within the dimensions of the bucket when compared with the instant application, and would not appear to provide the continuous mode of operation set forth in the instant application, since a time lag must be present in order to assure a still water condition within the bucket.

By way of contrast, the instant application is directed to and claims a trough having a conveyor operatively disposed thereon and driven by a suitable source so that an oil water interface can meet the conveyor in such a manner that the oil is carried upon the conveyor and the water is allowed to be discharged through plural openings within the trough in a highly efficient manner. Thereafter, the oil which is retained upon the conveyor is removed by a suction device and thereafter is stored in a reservoir provided with further means for separating whatever water continues to be associated with the oil and passed into the reservoir.

SUMMARY AND OBJECTS OF THE INVENTION

Accordingly, this invention has as an object to provide a device for removing a substance from a liquid body in which the mode of operation advantageously utilizes the inherent immiscibility of the liquid and the substance.

It is a further object of this invention to provide a device of the character described above which is of continuous operation and not batch orientated so as to provide an efficient collection device.

It is still a further object of this invention to provide a device of the character described above which is relatively inexpensive to manufacture, extremely durable in construction, and relatively safe to use.

It is still a further object of this invention to provide a device of the character described above which can retrieve substances of varying viscosities in a highly efficient manner.

These and other object will be made manifest when considering the following detailed specification when taken in conjunction with the appended drawing figures wherein a mechanism is provided which is suitably attached to a ship or other vehicle and has a trough and a conveyor operatively disposed thereon and driven, a means for angulating the trough so as to vary the angle of attack of the trough to the body of the liquid, a means for separating the oil from the water on the conveyor so as to minimize the requisite amount of storage space and subsequent separation that is required, and a means for extracting the oil from the conveyor and placement thereafter into a reservoir so that the spilled oil can be salvaged.

BRIEF DESCRIPTION OF THE DRAWING FIGURES

FIG. 1 is a perspective view of the apparatus according to the present invention;

FIG. 2 is a sectional view taken along lines 2—2 of FIG. 1; and

FIG. 3 is a exploded parts view of a portion of the conveyor showing the separation process.

BRIEF DESCRIPTION OF THE PREFERRED EMBODIMENT

Referring to the drawings now, wherein like reference numerals refer to like parts throughout the various drawings, reference numeral 10 is directed to a spill retrieval mechanism for removing a spilled substance from a liquid surface and subsequent placement of the substance into a reservoir according to the present invention.

The spill retrieval mechanism 10 includes a trough having a bottom wall 1, a pair of spaced parallel side walls 3 and an outwardly diverging entry chute having flared side walls 2 extending and communicating with the side walls 3. The leading edge 4 of the trough flares outwardly as shown in the drawings so that a substantially great volume of water/oil is allowed to enter within the trough and the side walls 3 than would have occured had the inlet chute not been splayed outwardly. The net effect of having an inlet which converges to a conveyor 8 is to increase the liquid level height and to assist the water/oil to be carried upon the conveyor.

The conveyor 8 itself is formed as an endless belt and is provided with a plurality of upstanding resilient fingers 9 all of which are substantially cylindrical in shape, and these fingers as well as an outer surface of the conveyor belt is coated with an oleophilic substance to encourage the spilled oil to be retained thereon. Clearance 27 between the side walls 3 and the conveyor 8 provide an avenue of egress for the water to roll off of the conveyor and thereafter holes 5 provided on a lower area of the trough below the conveyor will cause this cleansed water to pass therethrough. In this manner therefore the substance that remains on the conveyor to the removal means is substantially free of the diluent water and any further separation between the oil and the water will not require large volume storage facilities.

Means for angulating the trough are provided so as to change the rake angle or the angle of the trough to its contact to the water surface as required. For example, oil which is exceedingly viscous may not disperse as thinly on a body of water as would a lighter grade of refined oil, and therefore the amount of penetration of the leading edge 4 of the trough should be varied to accommodate oil spills of various viscosities. To this end, first and second ears 6 are provided on a top edge of the side walls of the trough 3 and these ears support a pair of rods 7 which extend upwardly to the ship. Interposed within a portion of the rod 7 there is provided an extensible cylinder 26 which will vary the length of the rod arm so as to alter the amount of penetration of a leading edge 4 of the trough into the water. This angulation variation is also beneficial in avoiding the admission of flotsam and other debris into the inlet chute and can be continuously monitored if provided with sensors to control the angle of attack.

A bellows type flexible coupling 11 extends between a wall 17 of the reservoir and a perimeter of an end portion of the trough to enhance a flexible pivotable connection between the reservoir wall 17 and each side wall 3 of the trough through a pivot 16 as shown in FIG. 2. The bellows coupling 11 tends to exclude the admission of water and spray at this stage of the collection apparatus should the vehicle be operated in rough seas or the like.

A bottom portion of the trough proximate to the reservoir is provided with a shoulder having a vertical wall 12 and a horizontal shelf 13 which horizontal shelf extends substantially co-planar with a lowermost portion of the conveyor so that a removal means can be supported and placed thereon for extraction of the oil on the conveyor. More specifically, the removal means includes a suction tube 14 having a suction pump 15 operatively disposed thereon in which an opening is placed proximate to an end of the conveyor remote from the leading edge 4 of the trough so that the vacuum pressure can cause the oil contained upon the resilient fingers 9 and on the conveyor fabric 8 itself to be extracted therefrom and placed in a reservoir R as best seen in FIG. 2. The reservoir is provided with a pump 18 having an outlet 19 so that whatever water does accumulate in the tank can be automatically removed by the energization thereof thereby minimizing the amount of storage capacity and subsequent separation, by virtue of the unique characteristics of the conveyor.

The conveyor 8 is operatively driven by a motor 20 having a motor sprocket 21 which communicates with a further sprocket 23 by means of a chain 22, the sprocket 23 operatively associated with a roller shaft 24 so as to drive the conveyor. A second shaft 25, like the first shaft 24 extends between side walls 3 of the trough and supports the conveyor as best shown in FIG. 2.

In use and operation therefore, an appropriate angle of attack is selected or may be continuously varied depending upon the scavenging requirements, and the conveyor is caused to move in the direction of travel T as shown in FIG. 2. Water and oil contact a leading edge of the conveyor and the oil is caused to ride upon the conveyor and be retained thereon by the oleophilic substance the conveyor in cooperation with the resilient fingers 9 which assist in carrying lumps of the oil if present. Thereafter, excess water inadvertantly carried upon the conveyor escapes to a lower portion of the trough through the clearance 27 mentioned supra. As explained thereafter, these scavenging means direct the oil into the reservoir. It is believed that not forcing the oil to a lower level but rather utilizing the natural tendency to float on the water provides the ability for the apparatus to proceed at an optimum rate without undergoing the arduous task of subsequent plural separations of the liquid as the prior art would suggest.

Since the lower most portion of the conveyor is substantially coplanar with the top edge of the flared side walls 2, there is a greater surety that oil will not pass under the conveyor. Similarly, the placement of the suction tube 14 proximate to the uppermost portion of the conveyor encourages complete scavenging of the carried oil.

Moreover, having thus described the invention, it should be apparent that numerous structural modifications are contemplated as being part of this invention as set forth hereinabove and defined hereinbelow by the claims.

What I claim is:

1. A spill retrieval mechanism for removing a spilled substance such as oil from a liquid surface such as water and placing the substance in a reservoir comprising, in combination:

trough means extending between the liquid and said reservoir, said trough is formed with a bottom surface having a pair of spaced parallel upwardly extending side walls provided with a clearance from said conveyor means and a plurality of outlets below said conveyor means to allow water to pass therethrough, an inlet chute having a leading edge which flares outwardly, and complementarily formed diverging outwardly flared side walls which communicate and extend to said parallel walls, conveyor means operatively disposed on said trough and driven to cause the oil to be carried on a top face thereof, angulation means operatively connected to said trough to vary the angle of attack of said trough to the liquid, retention means on said conveyor for holding the substance on said top face while allowing the liquid to run off, and removal means extending between said conveyor and said reservoir to place the substance in said reservoir.

2. The mechanism of claim 1 in which said conveyor means and said retention means include a coating upon said conveyor means which is oleophilic, and a plurality of upstanding substantially cylindrical resilient fingers to assist in retaining oils of various viscosities upon said top face of said conveyor means.

3. The device of claim 2 in which a top edge of said trough wall is provided with a pair of rods having an extensible means thereon connected to said reservoir for controlling the angle of attack of said leading edge of said trough.

4. The device of claim 3 in which said conveyor means is formed as an endless belt and is driven by a motor having a first motor sprocket which drives a second sprocket carried on a conveyor shaft through a chain, said conveyor means having an extremety remote from said driven sprocket provided with a further shaft to support said conveyor said shafts mounted on said side walls.

5. The device of claim 4 in which said retrieval means comprises a suction tube placed proximate to an end of said conveyor remote from said inlet ducts, said suction tube including a suction pump for sucking the oil contained upon the conveyor rearwardly into said reservoir, said suction tube having an end extending within the reservoir for disposition therein of the oil.

6. The device of claim 5 wherein said suction tube is disposed upon a horizontal shelf formed as a portion of said trough, said shelf having a vertically extending leg communicating with said bottom wall of said trough whereby said suction tube is substantially coaxial with an upper end of said conveyor.

7. The device of claim 6 in which a bellows shroud is provided along an end portion of said trough proximate to said reservoir to minimize the amount of contamination of water spray and the like on said conveyor and in which said reservoir is provide with a pump along a bottom wall floor edge having an outlet whereby any additional water that has not been separated from the oil can be pumped out.

8. The device of claim 7 wherein said top surface of said conveyor means is substantially coplanar with a top edge of said outwardly flared side walls so that in maximum use, the liquid initially extends just above said top surface of said conveyor.

9. The device of claim 8 wherein said flared walls extend forwardly beyond said conveyor means.

* * * * *